US009510405B2

(12) United States Patent
Bhardwaj et al.

(10) Patent No.: US 9,510,405 B2
(45) Date of Patent: Nov. 29, 2016

(54) DUAL POWER SMPS FOR A MODULAR LIGHTING SYSTEM

(71) Applicant: SCHNEIDER ELECTRIC INDUSTRIES SAS, Rueil-Malmaison (FR)

(72) Inventors: Dhruv Bhardwaj, Karnataka (IN); Rupan Sarkar, Karnataka (IN)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/471,667

(22) Filed: Aug. 28, 2014

(65) Prior Publication Data

US 2014/0368118 A1 Dec. 18, 2014

Related U.S. Application Data

(63) Continuation of application No. 14/129,405, filed as application No. PCT/IN2012/000462 on Jun. 29, 2012, now abandoned.

(30) Foreign Application Priority Data

Jun. 30, 2011 (IN) ..... 874/KOL/2011

(51) Int. Cl.
*H05B 33/08* (2006.01)

(52) U.S. Cl.
CPC ..... *H05B 33/0815* (2013.01)

(58) Field of Classification Search
CPC ..... H05B 33/0815; H05B 33/0818; H05B 37/029; H05B 37/02; H05B 41/3925
USPC ..... 315/291, 224, 307, 175; 307/66; 320/101
See application file for complete search history.

(56) References Cited

U.S. PATENT DOCUMENTS 5,559,393 A 9/1996 Nilssen
5,869,949 A * 2/1999 Nishikawa et al. ..... 320/101
(Continued)

FOREIGN PATENT DOCUMENTS

CN 200946783 Y 9/2007
CN 200950553 Y 9/2007
(Continued)

OTHER PUBLICATIONS

English Translation of DE 20 2005 018887 U1, Roos Horstj., Mar. 23, 2006.*
(Continued)

*Primary Examiner* — Douglas W Owens
*Assistant Examiner* — Syed M Kaiser
(74) *Attorney, Agent, or Firm* — Lando & Anastasi, LLP

(57) ABSTRACT

Methods and systems described herein provide efficient lighting where electric grid systems are unreliable. One aspect includes a light assembly that includes an input to receive power from a power source, a controllable power supply having a control input, a power input coupled to the first input, and an output to provide a voltage level controllable based on a control signal received at the control input, a light circuit coupled to the output of the controllable power supply and configured to provide output light in response to the output voltage, a feedback circuit configured to detect a current to a battery and a voltage across the battery and having an output coupled to the control input of the controllable power supply to provide the control signal to the controllable power supply based on at least one of the current to the battery input and the voltage across the battery.

17 Claims, 7 Drawing Sheets

(56) References Cited

U.S. PATENT DOCUMENTS

| | | | | |
|---|---|---|---|---|
| 8,657,460 | B2 | 2/2014 | Bhardwaj et al. | |
| 2002/0019396 | A1 | 2/2002 | Morgan et al. | |
| 2002/0067143 | A1 | 6/2002 | Robinett et al. | |
| 2005/0231381 | A1 | 10/2005 | Pederson et al. | |
| 2006/0043911 | A1 | 3/2006 | Shao et al. | |
| 2008/0212329 | A1 | 9/2008 | Duguay et al. | |
| 2008/0278111 | A1* | 11/2008 | Genies et al. | 320/101 |
| 2009/0096413 | A1* | 4/2009 | Partovi et al. | 320/108 |
| 2009/0109670 | A1 | 4/2009 | Boyer | |
| 2009/0116210 | A1 | 5/2009 | Cutler et al. | |
| 2009/0135611 | A1 | 5/2009 | Lin | |
| 2009/0174542 | A1 | 7/2009 | Gentry et al. | |
| 2010/0038965 | A1* | 2/2010 | Rohner et al. | 307/66 |
| 2010/0327766 | A1* | 12/2010 | Recker et al. | 315/291 |
| 2011/0133655 | A1* | 6/2011 | Recker et al. | 315/159 |
| 2011/0215641 | A1* | 9/2011 | Peterson et al. | 307/23 |
| 2014/0191624 | A1* | 7/2014 | Jahshan | 310/68 B |

FOREIGN PATENT DOCUMENTS

| | | | | |
|---|---|---|---|---|
| CN | 101340107 | A | 1/2009 | |
| CN | 201218473 | Y | 4/2009 | |
| CN | 101765277 | A | 6/2010 | |
| DE | 202005018887 | U1 * | 4/2006 | F21V 23/00 |
| EP | 1849335 | A1 | 10/2007 | |
| EP | 2023037 | A1 | 2/2009 | |
| WO | 0233311 | A1 | 4/2002 | |
| WO | 2006060905 | A1 | 6/2006 | |
| WO | 2007113498 | A2 | 10/2007 | |
| WO | 2011024062 | A2 | 3/2011 | |
| WO | 2012010963 | A1 | 1/2012 | |

OTHER PUBLICATIONS

Notification of Transmittal of the International Search Report and the Written Opinion of the International Searching Authority from corresponding PCT/IN2012/000462 dated Oct. 5, 2012.

* cited by examiner

DUAL POWER SMPS FOR A MODULAR LIGHTING SYSTEM

This application is a continuation of U.S. patent application Ser. No. 14/129,405 entitled "DUAL POWER SMPS FOR A MODULAR LIGHTING SYSTEM," filed on Jun. 29, 2012, which is a National Stage Application under 35 U.S.C. §371 from PCT/IN2012/000462, filed Jun. 29, 2012, which claims the benefit of Indian Application Serial No. 874/KOL/2011, entitled "DUAL POWER SMPS FOR A MODULAR LIGHTING SYSTEM," filed on Jun. 30, 2011. All of the foregoing prior applications are incorporated herein by reference in their entirety.

BACKGROUND

1. Field of Invention

At least one embodiment in accordance with the present invention relates generally to switch mode power supplies and more particularly to systems and methods of providing a dual power Switch Mode Power Supply (SMPS) for a modular lighting system.

2. Discussion of Related Art

Solar, battery and electric grid lighting systems are well known, including those that use incandescent bulbs, fluorescent bulbs, and light emitting diodes (LEDs) as light sources. In underdeveloped and/or developing countries and in rural areas, the availability of reliable electric grid power systems remains spotty at best and alternate source systems can be expensive to install and operate and are not always compatible with available lighting sources. Efficient lighting systems may be used particularly in areas having unreliable and or prohibitively expensive electric grid systems. Designers of such lighting systems look for ways of reducing components in the lighting system while providing a reliable source of power to lighting modules.

SUMMARY OF INVENTION

At least one embodiment discussed herein is directed to an efficient lighting system for use particularly in areas having unreliable and or prohibitively expensive electric grid systems.

A first aspect of the invention is directed to a light assembly that includes a first input to receive power from a power source, a controllable power supply having a control input, a power input coupled to the first input, and an output to provide an output voltage having a voltage level controllable based on a control signal received at the control input, a battery input coupled to the output of the controllable power supply, and configured to couple to a battery, a light circuit coupled to the output of the controllable power supply and configured to provide output light in response to the output voltage, a feedback circuit configured to detect a current to the battery and a voltage across the battery and having an output coupled to the control input of the controllable power supply to provide the control signal to the controllable power supply based on at least one of the current to the battery input and the voltage across the battery.

In the light assembly, the controllable power supply may further include a PWM controller coupled to the power input. The PWM controller may be configured to generate a pulse width modulated signal having a duty cycle. The PWM controller may be further configured to decrease the duty cycle of the pulse width modulated signal based on the control signal having a first state indicating that at least one of the current to the battery input and the voltage across the battery is above a threshold. The PWM controller may be also configured to increase the duty cycle of the output voltage based on the control signal having a second state different from the first state. The controllable power supply may comprise a transformer, configured to receive power from the power input. The first input may be configured to receive power from an AC power source.

The light assembly may further comprise a second input configured, to receive power from a solar power source. The light assembly may additionally comprise a DC-DC converter having a converter control input, a power input coupled to the second input, and a converter output to provide a converter output voltage having a converter voltage level controllable based on a converter control signal received at the converter control input, a converter feedback circuit configured to detect a current to the battery and a voltage across the battery and having an output coupled to the converter control input of the DC-DC converter to provide the converter control signal to the DC-DC converter based on at least one of the current to the battery input and the voltage across the battery. The light circuit may be coupled the converter output and configured to provide output light in response to the converter output voltage.

Another aspect of the invention is directed to a method of illuminating a room. The method includes receiving power from a power source, generating a DC voltage derived from the received power, the DC voltage having a voltage level, applying the DC voltage to a light circuit, applying the DC voltage to the battery, detecting a current to the battery, detecting a voltage across the battery, and controlling the voltage level based on at least one of the current to the battery and the voltage across the battery.

In the method, the act of controlling the voltage level may further comprise generating a pulse width modulated signal having a duty cycle. The act of controlling the voltage level may further comprise decreasing the duty cycle of the pulse width modulated signal if at least one of the current to the battery and the voltage across the battery is above a threshold. The act of controlling the voltage level may further comprise increasing the duty cycle of the pulse width modulated signal until the current to the battery has reached a threshold or the voltage across the battery has reached a threshold. The act of generating a DC voltage may further comprise using a transformer to step down a voltage derived from the received power. The act of receiving power from a power source may further comprise receiving power from at least one of an AC power source and a solar power source. The method may further include providing power to the light circuit from the battery.

Another aspect of the invention is directed to a light assembly that includes at least one input to receive power from a power source, a controllable power supply having a control input, a power input coupled to the at least one input, and an output, a battery input coupled to the output of the controllable power supply, a light circuit coupled to the output of the controllable power supply and configured to provide output light, and means for controlling the power supply to provide a regulated voltage to the light circuit and regulated charging current and charging voltage to a battery coupled to the battery input.

In the light assembly, the at least one input may include a first input configured to couple to an AC power source and a second input configured to couple to a solar power source. The controllable power supply may be configured to provide output DC power to the battery input and to the light circuit. The light assembly may further include means for detecting loss of AC power at the at least one input and for providing power to the light circuit from the battery. In the light assembly, the means for controlling may include means for charging the battery in a first mode supplying substantially constant current to the battery, and means for charging the battery in a second mode supplying a substantially constant voltage across the battery.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
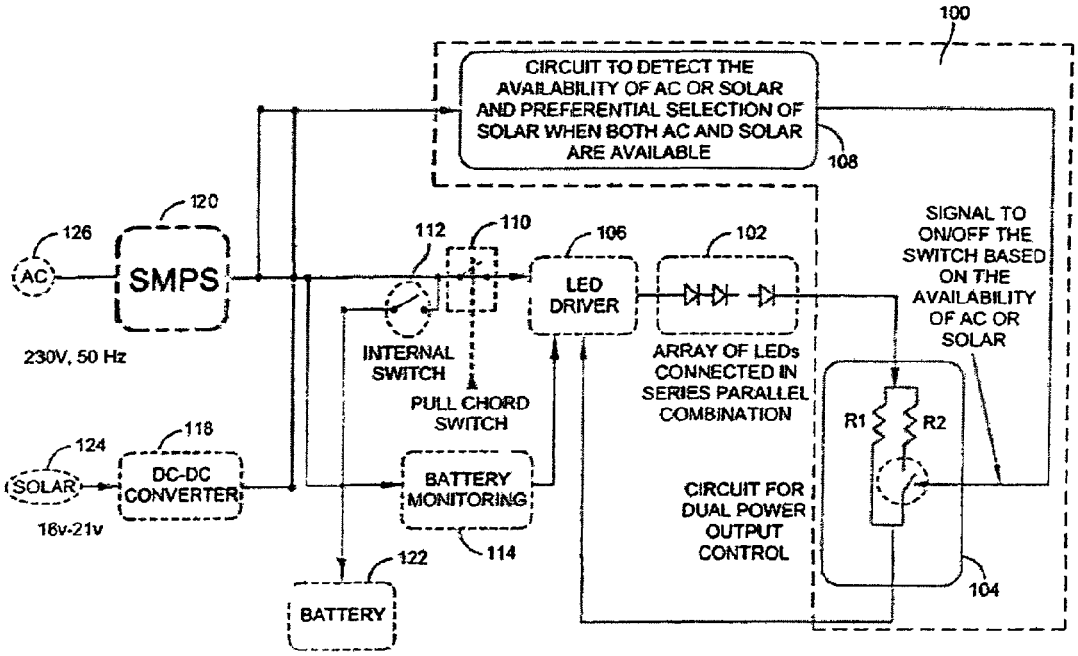
FIG. 1 shows a functional block diagram of a lighting system, in accordance with one embodiment.

As discussed above, it is desirable to reduce the number of components in efficient lighting systems to reduce the cost of the overall system, while providing a solution that is functionally uncomplicated and easy to implement.

The devices and methods described herein are not limited in their application to the details of construction and the arrangement of components set forth in the description or illustrated in the drawings. The devices and methods are capable of other embodiments and of being practiced or of being carried out in various ways. Examples of specific implementations are provided herein for illustrative purposes only and are not intended to be limiting. In particular, acts, elements and features discussed, in connection with any one or more embodiments are not intended to be excluded from a similar role in any other embodiments. Also, the phraseology and terminology used herein is for the purpose of description and should not be regarded as limiting. The use of "including" "comprising" "having" "containing" "involving" and variations thereof herein, is meant to encompass the items listed thereafter and equivalents thereof as well as additional items.

At least some embodiments disclosed herein are directed to modular, efficient lighting systems and methods, including LED lighting systems, operable from DC power sources including battery power sources, fuel cells, and solar power, and AC power sources including a utility electrical grid, generator or other AC power source. At least some embodiments are directed to LED lighting systems that are configurable for dual power mode operation to allow low power operation on battery power. At least some embodiments are directed to providing a dual power switch mode power supply configured to regulate the supply of power from both the AC power sources and DC power sources and to provide constant power to both the LED lighting sources and the battery to charge the battery.

FIG. 1 is directed to a functional block diagram of a modular LED lighting system 100 in accordance with one embodiment. The lighting system 100 includes an array of LEDs 102, a dual power output control circuit 104, an LED driver circuit 106, a detection circuit 108, mode switches 110 and 112, a battery monitoring circuit 114, a DC-DC converter 118, a dual power Switch Mode Power Supply (SMPS) 120, a battery 122, a solar power source 124, and an AC power source 126. In different embodiments, functional circuits may be grouped differently than shown in FIG. 1.

The LED array 102 is coupled between the dual power output control circuit 104 and the LED driver 106. Mode switches 110 and 112 are coupled between the LED driver circuit 106 and the battery 122, and the mode switches are also coupled to an output of the dual power SMPS 120. The DC-DC converter 118 is coupled between the solar power source 124 and the the mode switches 110 and 112. The dual power SMPS 120 is coupled between the AC power source and the mode switches 110 and 112. The battery 122 is coupled to the dual power SMPS 120, mode switch 112 and the battery monitoring circuit 114. The detection circuit 108 is coupled to the dual power SMPS 120 output, DC-DC converter 118 output and the dual power output control circuit 104.

In operation, light is provided by the LED array from power provided from one of the AC power source 126, the solar power source 124 and the battery 122. When operated from the AC power source 126 or from the solar mode of operation, the dual power SMPS 120 provides one output of voltage to the LED driver 106 and LED array 102 and provides another output of voltage and constant current to the battery 122.

In AC mode of operation, mode switch 112 is open to isolate the battery, while mode switch 110 is configured to couple the output of the dual power SMPS 120 to the LED driver circuit 106. The LED driver circuit 106 receives the output of voltage of the dual power SMPS 120 and provides an output constant current for the LED array 102 to light the LEDs. In solar mode of operation, mode switch 110 is configured to couple the output of the DC-DC converter 118 to the LED driver circuit 106. In one embodiment, the DC-DC converter is configured to receive DC power from an external solar power system 124 having a voltage between 16 volts and 21 volts and to provide output DC power of 14.5 volts to the battery 112 and the LED driver circuit 106. In other embodiments, other voltages may be used to accommodate operation with other solar power systems.

The dual power output control circuit 104 is used to provide a low power mode of operation of the lighting system 100 when operated from battery power. In the AC and solar modes of operation, the dual power output control circuit 104 is controlled to operate in normal, high power mode of operation.

In battery mode of operation, DC power is provided from the battery 122 to the internal switch 112, and both mode switch 112 and mode switch 110 are configured to couple the output of the battery to the input of the LED driver. In one embodiment, the lighting system is configured to operate with a battery having an output voltage of 11.5 volts to 13.5 volts, but in other embodiments, other battery voltages may be used. In at least one embodiment, the lighting system is configured to operate with an external battery to accommodate larger, higher capacity batteries, however, in other embodiments; an internal battery may be used in addition to an external battery or in place of the external battery.

The detection circuit 108, detects the present of AC and solar power, and in one embodiment, selects operation from the solar power source when both AC power and solar power is available to operate the lighting system 100 in a more economical manner. The detection circuit 108 also provides a signal to the dual power output control circuit 104 to control the circuit for high power operation if either AC power or solar power is available. If neither AC power nor solar power is available, then the detection circuit 108 controls the dual power output control circuit to operate in low power mode. Operation of the lighting system at low power in battery mode of operation allows the battery to operate for a longer period of time.

In one embodiment, the dual power output control circuit 104 is implemented using parallel resistors in series with the LED array, and a switch (such as a transistor) is used to alter the value of the resistance in series with the LED array to limit the drive current to the LED array. In one embodiment, the total current through the LED array is 580 mA in high power mode of operation and is reduced to 500 mA in low power mode of operation. However, depending on the number and type of LEDs used in the array, other values of drive current may be used in other embodiments.

As shown in FIG. 1, mode switch 110 is a pull cord switch that may be used by a user to power the lighting system 100 on and off. As shown in FIG. 1, in one embodiment, the pull cord switch is connected between the dual power SMPS 120 output, internal switch 112 and LED driver 106.

In one embodiment, the internal switch 112 is a controllable switch, such as a diode. The switch may be controlled by forward biasing or reverse biasing the diode. The diode is reverse biased when the power is available either from dual power SMPS 120 and/or DC-DC converter 118 thereby disconnecting the LED driver 106 from the battery 122. The diode is forward biased when the power is not available either from dual power SMPS 120 or from DC-DC converter 118 and the lighting system 100 is powered from the battery 122. In one embodiment, switch 112 is controlled to be in the open position if solar or AC power is available, and if neither is available, the switch 112 is closed to couple the battery 122 to the LED driver 106.

In one embodiment, if solar power is available from the DC-DC converter 118, power is shared between the battery 122 and the LED driver 106. Available power from the solar source can be used to power the LED array 102 and any remaining power will be used to charge the battery 122.

In one embodiment, the battery monitoring circuit 114 is coupled to output of battery 122 and LED driver 106. This circuit monitors remaining charge of the battery and gives a signal to the driver 106 to cut off the power supply to LED array 102 when the battery drains to 50% of its full charge level. In other embodiment the battery may be drained to 80% of its full charge level. The RED indication LED is ON, when the battery drains to 50% of its full charge capacity and the pull switch 110 is ON position.

Figure 2A:
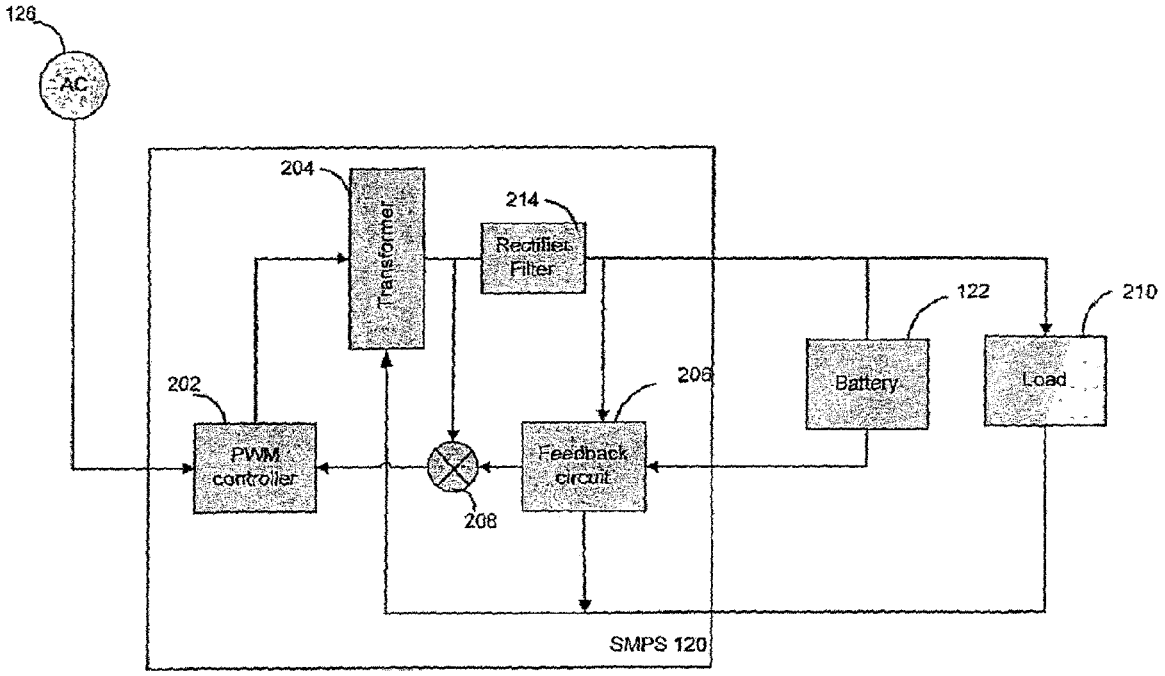
FIG. 2A shows a functional block diagram of a dual power SMPS used in the embodiment of FIG. 1.

Referring now to FIG. 2A, there is illustrated a block diagram of one example of a dual power SMPS 120 coupled to a battery 122 and a load 210. The dual power SMPS 120 includes a PWM (Pulse Width Modulation) controller 202, a transformer 204, a feedback circuit 206, a rectifier and filter 214 and a multiplexer 208. The load 210, in one embodiment, is a light circuit that includes the LED driver 106 and the LED array 102.

When operated from the AC power source 126, the dual power SMPS receives the input AC power and converts the AC power to DC power. During the AC power to DC power conversion, the input AC power may be filtered by an EMI (Electro-Magnetic Interference) filter, converted to DC power by a rectifier and smoothed by a capacitor filter. In one embodiment, with an input AC voltage of 230 volts at 50 Hz, the resultant DC power has a relatively high voltage of 230 volts. In other embodiments, other input voltages may be used and single phase or multi-phase power may be used.

The PWM controller 202 receives the high voltage DC power and provides high frequency pulse width modulated output power to transformer 204. In one embodiment, a switching frequency of 62 kHz is used by the PWM controller 202. The transformer 204 receives power from the PWM controller 202 and steps down the high voltage to provide a lower voltage. The dual power SMPS 120 provides the lower voltage to the load 210 to power the LED array 102. The SMPS 120 may have one or more rectifier and filter circuits 214 that are made of smoothing components that rectify AC power to DC power and filter components that filter the DC power to provide, in one embodiment, a controlled output voltage to charge the battery and power to the lighting system 100.

The dual power SMPS 120 also provides power to charge the battery. The battery 122 may be charged from either AC power, or if AC power is not available from the solar power provided by the DC-DC converter 118. The battery is charged in two modes: a constant current mode and a constant voltage mode. The two charging modes protect the battery from overcharging at the end of the charging cycle and provide better charge termination at the end of the charge. If the battery is discharged, the dual power SMPS will charge the battery in constant current mode at a constant current until the charge on the battery reaches a battery current charging threshold. Once the voltage on the battery reaches the battery current charging threshold, the dual power SMPS 120 will charge the battery in constant voltage mode at a constant voltage. The dual power SMPS 120 will charge the battery at the constant voltage until the battery reaches a battery voltage charging threshold indicating that the battery is fully charged.

To switch between modes the dual power SMPS 120 determines the current and the voltage on the battery. To determine the current and the voltage on the battery, the feedback circuit 206 receives the voltage from the transformer 204 and provides a voltage indication of the sensed current output to the multiplexer 208. A voltage signal indication of the voltage across the battery 122 is also provided to the multiplexer 208. The multiplexer 208 triggers a feedback signal to the PWM controller 202 if the current through the battery reaches the battery current charging threshold or if the voltage on the battery reaches the battery voltage charging threshold.

Figure 2B:
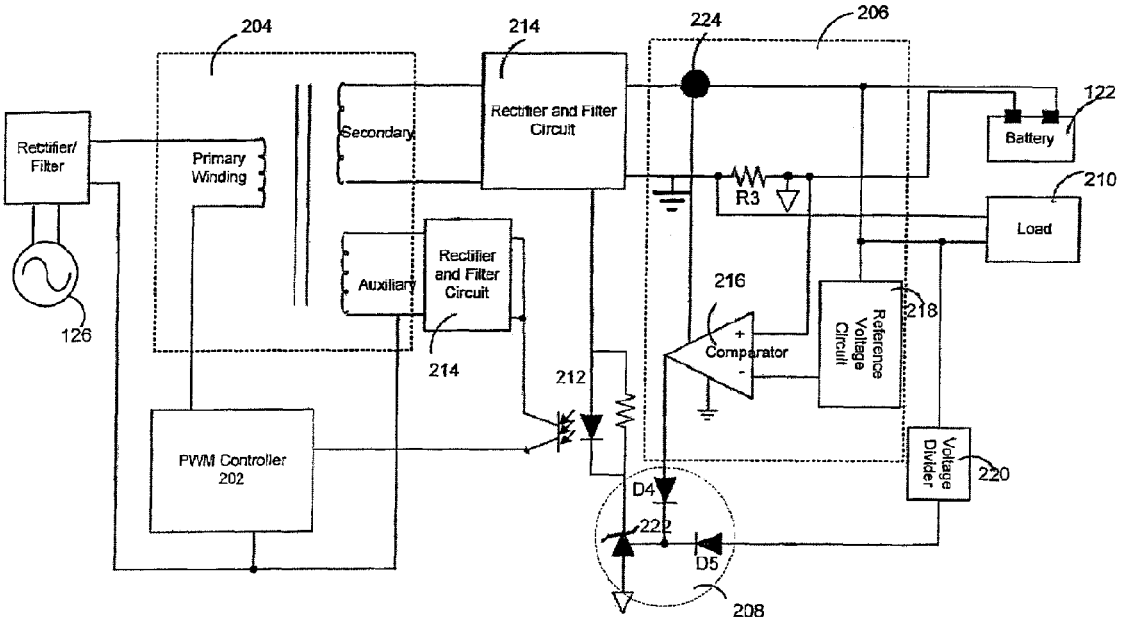
FIG. 2B shows a more detailed functional block diagram of the dual power SMPS shown in FIG. 2A.

The feedback provided to the PWM controller is described in more detail with reference to FIG. 2B. As shown in FIG. 2B, the transformer 204 includes a primary winding, a secondary winding and an auxiliary winding. The PWM controller 202 modulates power supplied to the primary winding of the transformer 204. The primary winding induces AC voltage in the secondary winding to produce AC voltage of lower amplitude as the secondary output. The primary winding also induces AC voltage in the auxiliary winding to produce AC voltage of lower amplitude as the auxiliary output. The auxiliary output is used to provide bias voltage to an optocoupler switch 212, which is used to isolate the feedback to the PWM controller 202. In one embodiment, the controlled output voltage range from 11.5 volts to 14.3 volts depending on the charge state of the battery.

In one embodiment, if solar power is available from the solar power input 124, the solar power will be used to charge the battery 122. In one example, DC power from the DC-DC converter 118 is provided at node 224. In one example, if both AC power and solar power are available, preference is given to solar power, because voltage from the DC-DC converter 118 is higher than voltage from the output of the rectifier and filter circuit 214. In one example, voltage from the DC-DC converter 118 is 14.5 volts, while voltage from the rectifier and filter circuit 214 is 14.3 volts. When the supply of solar power diminishes, AC power takes over and powers the battery 122 and the load 210.

As shown in FIG. 2B, the feedback circuit 206 comprises a current sense resistor R3 placed between the SMPS 120 ground and the battery 122 ground and in one example, has resistance of 0.03 Ohms. The feedback circuit has an op-amp comparator 216 that compares the voltage drop across the current sense resistor R3, as a voltage indication of the current across the battery, with a reference voltage 218 and outputs the sensed current to the multiplexer 208. The multiplexer 208 is comprised of two diodes, D4 and D5. The diode D4 receives output from the op-amp comparator 216 and the diode D5 receives voltage sensed across the battery, which is scaled down by a voltage divider 220. The multiplexed feedback signal from D4 and D5 is applied to a shunt regulator 220. In one embodiment, the shunt regulator 220 is a zener diode with internal reference voltage of 2.5 volts.

The function of the dual mode charging circuit will now be described in accordance with one embodiment. The voltage, current and resistance values used herein are for the purpose of example only and other values according to different characteristics of the battery can be used. According to one embodiment, if the battery is 80% discharged, the battery voltage will be approximately 11.5 volts. The voltage near the full charge is 13.5 volts and the full charge voltage is approximately 14.1 volts. However, other batteries may have other charging characteristics. In one embodiment, the constant current supplied to the battery is 3 amps, but other constant currents may also be used.

A discharged battery connected to the dual power SMPS 120 will result in a high current to the battery, because of the potential difference between the SMPS voltage and the battery voltage. The high current to the battery will generate a voltage across the sense resistor R3, which is connected to the non-inverting input of the op-amp comparator 216. A reference voltage generated by the reference voltage circuit 218 is 0.09 volts and is applied to the inverting input of op-amp 216.

When the op-amp non-inverting input voltage is greater than the inverting input voltage, then the op-amp output voltage will forward bias the diode D4. The voltage at the shunt regulator 222 provided by D4 diode will be more than the internal reference voltage of 2.5 volts and the shunt regulator 222 will provide a feedback control signal to the PWM controller through the optocoupler to reduce the pulse width of the PWM voltage at the primary winding. Diode D4 will stay forward biased until the current to the battery is reduced to 3 amps.

As the battery is charged, the battery voltage will increase and the potential difference between the charger voltage and the battery voltage will decrease toward zero. In one embodiment, to charge the battery at the constant current, the PWM controller 202 will increase the duty cycle of the PWM controller voltage pulse absent a feedback signal from the optocoupler 212. In this manner, the battery current is maintained at 3 amps during constant current mode.

The potential difference between the charger voltage and the battery voltage decreases as the battery charger and the voltage across the load increases. When the voltage across the load reaches 14.3 volts, the voltage divider will forward bias the diode D5 and send a feedback signal to the PWM controller. With the battery at or near full charge a constant voltage is maintained across the battery 122 and the load 210.

Figure 2C:
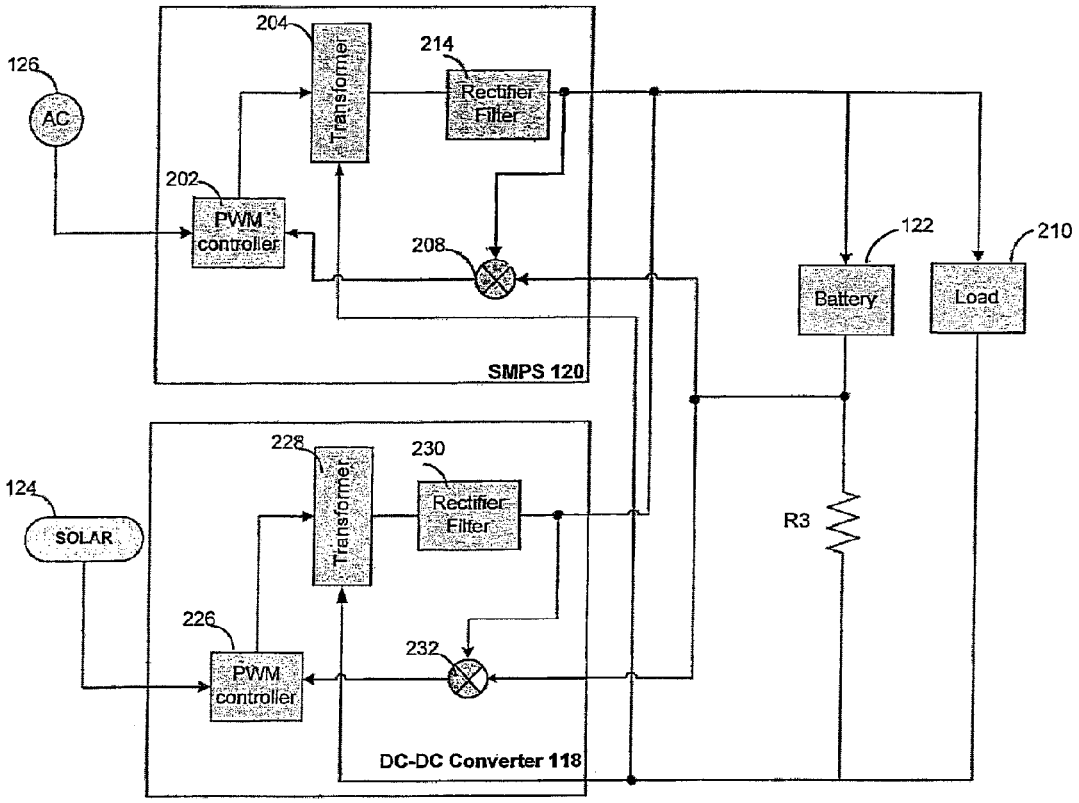
FIG. 2C shows a functional block diagram of a DC-DC convertor used in the embodiment of FIG. 1.

Referring now to FIG. 2C, there is illustrated a block diagram of one example of the use of a feedback scheme to control power of the solar power input 124 to power the load and to charge the battery. Similar to the feedback scheme for the AC power discussed with reference to FIGS. 2A and 2B, the feedback scheme in FIG. 2C can be used to regulate solar power to the battery 122 and the load 210. As shown in FIG. 2C, the feedback scheme includes the use of the DC-DC converter 118, which includes a PWM (Pulse Width Modulation) controller 226, a transformer 228, a rectifier and filter circuit 230, and a multiplexer 232.

When solar power is available, the DC-DC converter 118 receives the DC power from the solar power source 124. The PWM controller 226 receives the DC power from the solar source and provides high frequency pulse width modulated output power to transformer 228. In one example, the DC power has a voltage level between 16 volts and 21 volts. The transformer 228 receives power from the PWM controller 226 and steps down the received DC voltage to provide output AC voltage. The output AC voltage of the transformer 228 may be rectified, filtered and smoothed by the rectifier and filter circuit 230, to provide output DC power of 14.5 volts to the battery 112 and the load 210.

Similar to the feedback scheme of FIGS. 2A and 2B, the resistor R3 allows the DC-DC converter 118 to sense the current to the battery 122 and the voltage across the battery 122. The multiplexer 208 triggers a feedback signal to the PWM controller 202 if the battery reaches the battery charging threshold.

Figure 3:
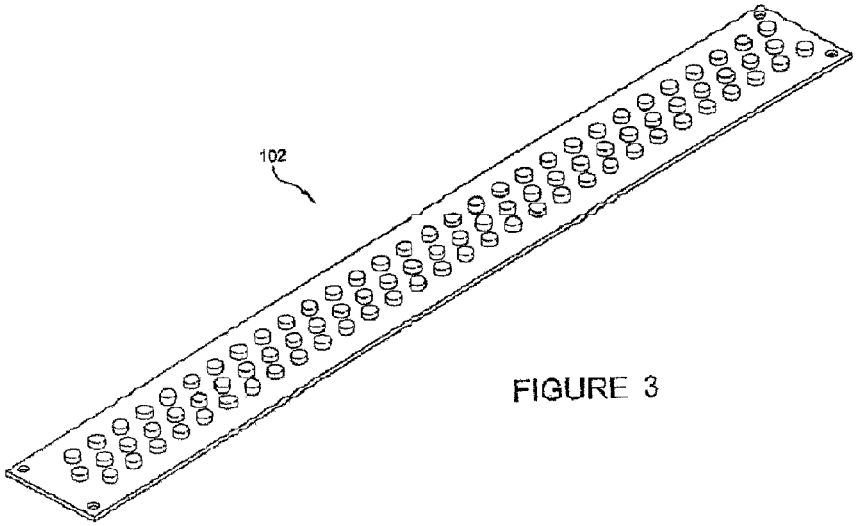
FIG. 3 shows an LED array used in the embodiment of FIG. 1.

In one embodiment, the LED array 102 is implemented using a 3×30 array of closely spaced LEDs as shown in FIG. 3. In one embodiment, the 3 rows are spaced 6.985 mm with the LEDs of each row spaced at 8.6 mm intervals, and with each LED having a 5 mm diameter. In on embodiment, the LEDs have a forward voltage of 3.0 to 3.5 volts, a peak forward current of 20 mA, a reverse voltage of 5 volts, reverse current of 10 microamps, a luminous intensity of 1500-2000 mod, and are white with a wavelength of 5800K. In other embodiments, LEDs having different characteristics may be used. In one embodiment, a green LED, a red LED and a yellow LED are also provided, and in this embodiment, illumination of the green LED indicates that the power from the grid supply or the solar panel is available and is charging the battery, illumination of the yellow LED indicates that the battery is FULL, and illumination of the red LED indicates that the battery is drained and load is cut off from the battery.

Figure 4:
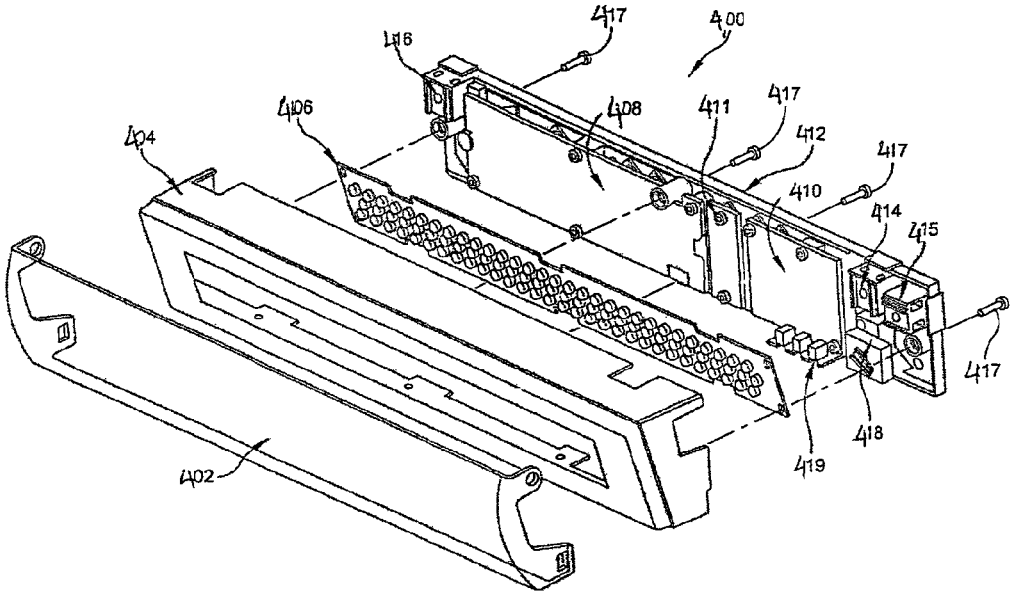
FIG. 4 shows an exploded view of a lighting assembly in accordance with one embodiment.
Figure 6:
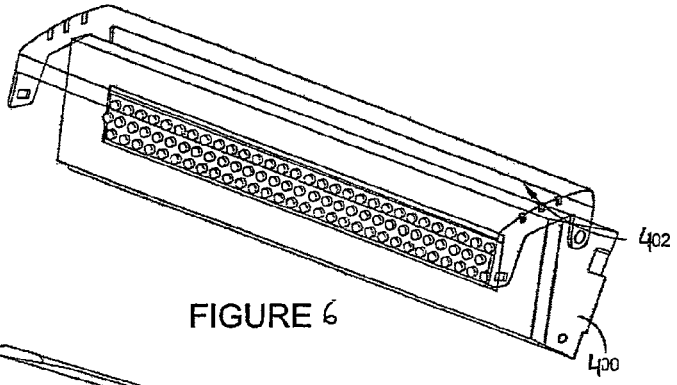
FIG. 6 shows a second perspective view of the lighting assembly of FIG. 4.
Figure 5:
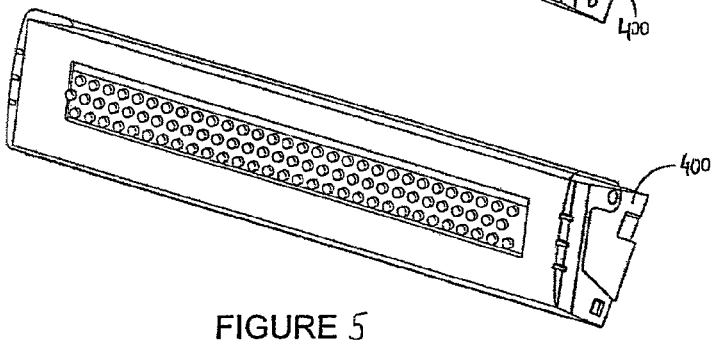
FIG. 5 shows a first perspective view of the lighting assembly of FIG. 4.

FIG. 4 shows an exploded view of an LED light assembly 400 in accordance with one embodiment, while FIGS. 5 and 6 show perspective views of the LED light assembly 400. The components of the functional block diagram of the lighting system 100 are contained within the LED light assembly 400, except that the AC power source, the solar power source and the battery are all external to the LED light assembly and are not shown in FIG. 4. The light assembly 400 includes a front cover 402, a case 404, an LED strip 406, a switch mode power supply board 408, an LED driver board 410, a solar board 411, a back cover 412, a solar power input terminal 414, a battery power input terminal 415, and an AC power input terminal 416. The LED light assembly also includes the pull switch 418 and the three LED indicator lights 419. In one embodiment, the LED light assembly 400 is fastened together using screws 417 as shown in FIG. 4.

As discussed in more detail below, in at least some embodiments, the LED light assembly 400 is a modular, upgradeable assembly, having several versions, and the specific electronics contained in the assembly can be varied based on the particular version of the assembly. More specifically, the SMPS board and the solar board may be removed or upgraded to change the version of the LED light assembly. To easily accommodate changing the SMPS board and the solar board, connection between the boards is accomplished in one embodiment using flexible cables between the boards with terminal block connectors coupling the cables to the boards. As shown in FIG. 4, the LED driver board, the solar board and the SMPS board are mounted to the back cover 412.

The LED strip in one embodiment contains the LED array 102 mounted on a printed circuit board with the board electrically coupled to the LED driver board 410. When assembled, the LED is mounted to the front of the case 404.

The case 404 and the back cover 412 in one embodiment are made form plastic (ABS Abstron IM 17A) while the front cover 402 is made from transparent plastic (PMMA 876G). In other embodiments, other plastic material can be used for the front cover 402, the case 404 and the back cover 412. In FIG. 5, the front cover is shown in an operational, closed position, while in FIG. 6, the front cover is shown in an open position that allows cleaning of any dust buildup on the front cover.

The input terminal 414 provides for connection to a solar power source, the input terminal 415 provides for connection to a battery, and input terminal 416 provides for connection to an AC source.

In embodiments discussed above a PWM controller is used as part of a controllable SMPS to provide regulated voltage and current to a battery and a load. In other embodiments other types of controllable power supplies may be used.

Embodiments of the dual power SMPS, as described above, may be used in other applications, including computers and computer peripherals, consumer electronics, such as, mobile phones, as well as, battery chargers. In at least some embodiments, an SMPS provides regulation of the battery charger and voltage to a load using a single PWM controller. In embodiments described above, three primary sources of power are discussed, AC grid, battery and solar. In other embodiments, light assemblies may be configured for operation with other power sources as well, including fuel cells and wind power.

Any references above to front and back, left and right, top and bottom, or upper and lower and the like are intended for convenience of description, not to limit the present systems and methods or their components to any one positional or spatial orientation.

Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements to single or plural configurations.

Any embodiment disclosed herein may be combined with any other embodiment, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. Such terms as used herein are not necessarily all referring to the same embodiment. Any embodiment may be combined with any other embodiment in any manner consistent with the aspects and embodiments disclosed herein. References to "or" may be construed as inclusive so that any terms described using "or" may indicate any of a single, more than one, and all of the described terms.

Where technical features in the drawings, detailed description or any claim are followed by references signs, the reference signs have been included for the sole purpose of increasing the intelligibility of the drawings, detailed description, and claims. Accordingly, neither the reference signs nor their absence have any limiting effect on the scope of any claim elements.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A light assembly comprising;

a first input to receive power from an AC power source;

a second input to receive solar power from a solar power source;

a controllable power supply having a control input, a power input coupled to the first input, and an output to provide an output voltage having a voltage level controllable based on a control signal received at the control input;

a battery input coupled to the output of the controllable power supply, and configured to couple to a battery that is configured to provide battery power;

a light circuit coupled to the output of the controllable power supply and configured to provide output light based on power from the AC power source, the solar power and the battery power;

a feedback circuit configured to detect a current to the battery and a voltage across the battery and having an output coupled to the control input of the controllable power supply to provide the control signal to the controllable power supply based on at least one of the current to the battery input and the voltage across the battery; and a resistor circuit coupled in series with a plurality of LEDs, the resistor circuit having a first configuration with a first resistance value in AC power mode of operation and a second configuration in battery mode of operation with a second resistance value in battery mode of operation, the first resistance value being less than the second resistance value.

2. The light assembly of claim 1, wherein the controllable power supply further comprises a PWM controller coupled to the power input, configured to generate a pulse width modulated signal having a duty cycle.

3. The light assembly of claim 2, wherein the PWM controller is configured to decrease the duty cycle of the pulse width modulated signal based on the control signal having a first state indicating that at least one of the current to the battery input and the voltage across the battery is above a threshold.

4. The light assembly of claim 2, wherein the PWM controller is configured to increase the duty cycle of the output voltage based on the control signal having a second state different from the first state.

5. The light assembly of claim 1, wherein the controllable power supply further comprises a transformer, configured to receive power from the power input.

6. A light assembly comprising;

a first input to receive power from an AC power source;

a second input to receive solar power from a solar power source;

a controllable power supply having a control input, a power input coupled to the first input, and an output to provide an output voltage having a voltage level controllable based on a control signal received at the control input;

a battery input coupled to the output of the controllable power supply, and configured to couple to a battery that is configured to provide battery power;

a light circuit coupled to the output of the controllable power supply and configured to provide output light based on power from the AC power source, the solar power and the battery power;

a feedback circuit configured to detect a current to the battery and a voltage across the battery and having an output coupled to the control input of the controllable power supply to provide the control signal to the controllable power supply based on at least one of the current to the battery input and the voltage across the battery;

a DC-DC converter having a converter control input, a power input coupled to the second input, and a converter output to provide a converter output voltage having a converter voltage level controllable based on a converter control signal received at the converter control input; and a converter feedback circuit configured to detect a current to the battery and a voltage across the battery and having an output coupled to the converter control input of the DC-DC converter to provide the converter control signal to the DC-DC converter based on at least one of the current to the battery input and the voltage across the battery, wherein the light circuit is coupled to the converter output and configured to provide output light in response to the converter output voltage.

7. A method of controlling operation of a light assembly comprising:

receiving power from an AC power source;

receiving power from a solar power source;

receiving power from a battery;

generating a DC voltage derived from the received AC power, the DC voltage having a voltage level;

selectively applying power from the AC power source the DC power source and the battery to a light circuit;

applying the DC voltage to the battery;

detecting a current to the battery;

detecting a voltage across the battery; and controlling the voltage level based on at least one of the current to the battery and the voltage across the battery;

wherein the light circuit includes a plurality of LEDs, and wherein the method further includes in an AC power mode of operation, providing a first current level through the LEDs, and in a battery mode of operation, providing a second current level through the LEDs, the second current level being less than the first current level.

8. The method of claim 7, wherein controlling the voltage level further comprises generating a pulse width modulated signal having a duty cycle.

9. The method of claim 8, wherein controlling the voltage level further comprises decreasing the duty cycle of the pulse width modulated signal if at least one of the current to the battery and the voltage across the battery is above a threshold.

10. The method of claim 8, wherein controlling the voltage level further comprises increasing the duty cycle of the pulse width modulated signal until the current to the battery has reached a threshold or the voltage across the battery has reached a threshold.

11. The method of claim 7, wherein generating a DC voltage further comprises using a transformer to step down a voltage derived from the received AC power.

12. The method of claim 7, further comprising driving the light circuit using AC power, detecting presence of solar power, driving the light circuit using solar power.

13. A light assembly comprising:

at least one input to receive power from an AC power source;

a controllable power supply having a control input, a power input coupled to the at least one input, and an output;

a battery input coupled to the output of the controllable power supply;

a light circuit coupled to the output of the controllable power supply and configured to provide output light;

means for controlling the power supply to provide a regulated voltage to the circuit and regulated charging current and charging voltage to a battery coupled to the battery input; and means for controlling the light circuit in an AC power mode of operation to provide a first current level through the light circuit based on power from the AC power source and for controlling the light circuit in a battery mode of operation to provide a second current level through the light circuit, the second current level being less than the first current level.

14. The light assembly of claim 13, wherein the at least one input includes a first input configured to couple to an AC power source and a second input configured to couple to a solar power source.

15. The light assembly of claim 13, wherein the controllable power supply is configured to provide output DC power to the battery input and to the light circuit.

16. The light assembly of claim 13, further comprising means for detecting loss of AC power at the at least one input and for providing power to the light circuit from the battery.

17. The light assembly of claim 13, wherein the means for controlling includes means for charging the battery in a first mode supplying substantially constant current to the battery, and means for charging the battery in a second mode supplying a substantially constant voltage across the battery.

* * * * *